US006551984B1

(12) United States Patent
Arvanitidou et al.

(10) Patent No.: US 6,551,984 B1
(45) Date of Patent: Apr. 22, 2003

(54) HIGH FOAMING, GREASE CUTTING LIGHT DUTY LIQUID COMPOSITION CONTAINING AT LEAST ONE NATURAL EXTRACT

(75) Inventors: Evangelia Arvanitidou, Kendall Park, NJ (US); Barbara Thomas, Princeton, NJ (US); David F. Suriano, Monroe Township, NJ (US); Karen Wisniewski, Bound Brook, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/259,043

(22) Filed: Sep. 27, 2002

Related U.S. Application Data

(63) Continuation-in-part of application No. 10/118,880, filed on Apr. 9, 2002, now Pat. No. 6,472,363.

(51) Int. Cl.[7] ..... C11D 17/00

(52) U.S. Cl. ..... 510/463; 510/424; 510/426; 510/490; 510/499; 510/505

(58) Field of Search ..... 510/463, 424, 510/426, 490, 499, 505

(56) References Cited

U.S. PATENT DOCUMENTS

| | | | | |
|---|---|---|---|---|
| 5,109,127 A | * | 4/1992 | Sekiguchi et al. | 536/115 |
| 6,369,013 B1 | * | 4/2002 | Gambogi et al. | 510/237 |
| 2002/0010114 A1 | * | 1/2002 | Dufay et al. | 510/310 |

* cited by examiner

*Primary Examiner*—Necholus Ogden
(74) *Attorney, Agent, or Firm*—Richard E. Nanfeldt

(57) ABSTRACT

A light duty, liquid comprising: at least one anionic surfactant, a supplemental surfactant, at least one natural extract, and water.

5 Claims, No Drawings

HIGH FOAMING, GREASE CUTTING LIGHT DUTY LIQUID COMPOSITION CONTAINING AT LEAST ONE NATURAL EXTRACT

RELATED APPLICATION

This application is a continuation in part application of U.S. Ser. No. 10/118,880 filed Apr. 9, 2002 now U.S. Pat. No. 6,472,363.

BACKGROUND OF THE INVENTION

The present invention relates to novel light duty liquid detergent compositions with high foaming and good grease cutting properties which contains a mixture of natural extracts, wherein some compositions exhibit increased shine as well.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent properties which has good grease cutting properties can be formulated with at least one anionic surfactant, an amphoteric surfactant such as a betaine surfactant or a nonionic surfactant, a mixture of natural extracts and water.

Accordingly, one object of this invention is to provide novel, high foaming, light duty liquid detergent compositions containing a mixture of natural extracts.

To achieve the foregoing and other objects and in accordance with the purpose of the present invention, as embodied and broadly described herein the novel, high foaming, light duty liquid detergent of this invention comprises at least one anionic surfactant, a zwitterionic surfactant, a mixture of fruit juices and water, wherein the composition does not contain a polyoxyalkylene glycol fatty acid, a builder, a polymeric thickener, a clay, abrasive, silicas, tricloscan, alkaline earth metal carbonates, alkyl glycine surfactant or cyclic imidinium surfactant.

DETAILED DESCRIPTION OF THE INVENTION

The present invention relates to a light duty liquid detergent which comprises approximately by weight:

(a) 1% to 60% of at least one anionic surfactant;

(b) 0.01% to 2.0%, more preferably 0.05% to 0.5% of a mixture of natural extracts in an aqueous solution comprising by weight: 10% to 15% of lime juice; 0.1% to 1.0% of mandarin fruit juice; 0.1% to 1.0% of honeydew melon fruit juice; 0.1% to 1% peach juice; 25% to 45% propylene glycol; and the balance being water;

(c) 0 to 20%, more preferably 0.1% to 20% of a supplemental surfactant selected from the group consisting of amphoteric surfactants, alkyl polyglucoside surfactants, ethoxylated and/or propoxylated nonionic surfactants, $C_{12}$–$C_{14}$ fatty acid alkanol amides, and amine oxide surfactants and mixtures thereof; and (d) 0 to 2.5 wt. %, more preferably 0.1 wt. % to 2 wt. % of a polymer for viscosity adjustment;

(e) the balance being water wherein the composition does not contain a glycol ether solvent, a polyoxyalkylene glycol fatty acid, a builder, a polymeric thickener, a clay, abrasive, silicas, triclosan, alkaline earth metal carbonates, alkyl glycine surfactant, cyclic imidinium surfactant, or more than 0.2 wt. % of a perfume or water insoluble hydrocarbon.

A preferred light duty liquid cleaning composition comprises approximately by weight:

(a) 10% to 20% of an alkali metal salt of a $C_8$–$C_{18}$ linear alkyl benzene sulfonate surfactant;

(b) 10% to 20% of an alkaline earth metal salt of a $C_8$–$C_{18}$ linear alkyl benzene sulfonate surfactant;

(c) 10% to 20% of an ammonium or alkali metal salt of a $C_8$–$C_{18}$ ethoxylated alkyl ether sulfate surfactant;

(d) 0.1% to 15% of a surfactant selected from the group consisting of a zwitterionic surfactant, fatty acid alkanol amides, alkyl poly-glucosides, ethoxylated nonionic surfactants and amine oxide and mixtures thereof;

(e) 0.1% to 2.5% of a proton donating agent;

(f) 0.01% to 1% of at least one natural extract;

(g) 0.1% to 7% of polyethylene glycol; and (h) 0 to 2.5%, more preferably 0.1% to 2%, most preferably 0.2% to 1.5% of an organic thickener; and (i) the balance being water.

The anionic sulfonate surfactants which may be used in the detergent of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates, $C_8$–$C_{18}$ ethoxylated alkyl ether sulfate, and mixtures thereof.

The paraffin sulfoantes may be monosulfonates or di-sulfonates and usually are mixtures thereof, obtained by sulfonating paraffins of 10 to 20 carbon atoms. Preferred paraffin sulfonates and those of $C_{12\text{-}18}$ carbon atoms chains, and more preferably they are of $C_{14\text{-}17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14\text{-}17}$ range will be minor and will be minimized, as will be any contents of di- or poly-sulfonates.

The $C_8$–$C_{18}$ ethoxylated alkyl sulfate surfactants which can be used in the instant compositions usually at a concentration of 10 wt. % to 20 wt. % have the structure $$R—(OCHCH_2)_nOSO^-{}_3M^+$$

wherein n is about 1 to about 22 more preferably 1 to 3 and R is an alkyl group having about 8 to about 18 carbon atoms, more preferably 12 to 15 and natural cuts, for example, $C_{12\text{-}14}$; $C_{12\text{-}15}$ and M is an ammonium cation, alkali metal or an alkaline earth metal cation, most preferably magnesium, sodium or ammonium.

The ethoxylated alkyl ether sulfate may be made by sulfating the condensation product of ethylene oxide and $C_{8\text{-}10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8\text{-}18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The alkali metal or salt of the $C_8$–$C_{18}$ linear alkyl benzene sulfonate surfactant is generally used in the instant compositions at a concentration of about 10 to 20 wt. %, more preferably about 10 wt. % to about 18 wt. %. The alkaline earth metal salt of the $C_8$–$C_{18}$ linear alkyl benzene sulfonate surfactant is usually used at a concentration of 10 wt. % to 20 wt. %, more preferably 10 wt. % to 18 wt. %. Examples of suitable sulfonated anionic surfactants are the well known higher alkyl mononuclear aromatic sulfonates such as the higher alkyl benzene sulfonates containing from 8 to 18 carbon atoms, more preferably 10 to 16 carbon atoms in the higher alkyl group in a straight or branched chain, $C_8$–$C_{15}$ alkyl toluene sulfonates and $C_8$–$C_{15}$ alkyl phenol sulfonates.

One of preferred sulfonates is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The water-soluble amphoteric or zwitterionic surfactant (betaine), which can be present in the light duty liquid detergent composition provides good foaming properties and mildness to the present composition. The zwitterionic surfactant is a water soluble betaine having the general formula:

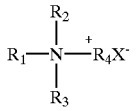

wherein $X^-$ is selected from the group consisting of $SO_3^-$ and $CO_2^-$ and $R_1$ is an alkyl group having 10 to about 20 carbon atoms, preferably 12 to 16 carbon atoms, or the amido radical:

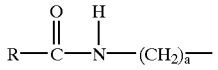

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia) acetate, coco dimethyl betaine or 2-(N-coco N,N-dimethylammonia)acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The natural extract used in the composition preferably comprises at least one fruit juice selected from the group consisting of lime juice, lemon juice, orange juice, tangerine juice, grapefruit juice, grape juice, apple juice, pear juice, pineapple juice, peach juice, mandarin juice, water melon juice, honeydew melon juice, cantaloupe juice, strawberry juice, raspberry juice, black currant juice, plum juice, prune juice, apricot juice, kiwi juice, pomegranate juice, and blackberry juice, and mixtures thereof.

An especially preferred mixture of natural extracts is Extrapone 4 Fruit Bundle, formulation ENTW/03, manufactured by the Dragoco Corporation of Totowa, N.J., which is an aqueous solution comprises approximately by weight:

(a) 10% to 15% of lime fruit juice;

(b) 0.1% to 1.0% of mandarin fruit juice;

(c) 0.1% to 1.0% of honeydew melon fruit juice;

(d) 0.1% to 1% of peach fruit juice;

(e) 25% to 45% of propylene glycol; and (f) the balance being water.

The water soluble nonionic surfactants which can be optionally utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 7 to 10 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The instant compositions can optionally contain an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, PA. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and (degree of polymerization)=1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

Amine oxide semi-polar nonionic surfactants comprise compounds and mixtures of compounds used in the compositions have the formula

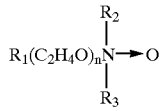

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

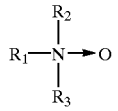

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

The proton donating agent which can be used in the instant composition is a hydroxy containing organic acid, which is ortho hydroxy benzoic acid or preferably a hydroxy aliphatic acid selected from the group consisting of lactic acid, citric acid, salicylic acid and glycolic and mixtures thereof.

Polyethylene glycol which is optionally used in the instant composition has a molecular weight of 200 to 1,000, wherein the polyethylene glycol has the structure $$HO(CH_2CH_2O)_nH$$

wherein n is 4 to 52. The concentration of the polyethylene glycol in the instant composition is 0.1% to 7 wt. %, more preferably 0.1 wt. % to 5 wt. %.

Organic thickeners used in the acidic instant compositions are selected from the group consisting of polyvinyl pyrrolidone of molecular weight between 1,000,000 to 2,000,000 (Luviskal K90, BASF), a polyethylene glycol having a molecular weight of 100,000 to 500,000 such as Polyox WSR-N750 from Dow Chemical and a polyquaterium-10 such as Ucare JR-125 from Amerchol which is quaternized hydroxyethyl cellulose.

The water is present at a concentration of 40 wt. % to 86 wt. %.

In addition to the previously constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of BASF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Sodium bisulfite can be used as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as ethanol, sodium chloride and/or sodium cumene or sodium xylene sulfonate and mixtures thereof are used at a concentration of 0.5 wt. % to 8 wt. % to assist in solubilizing the surfactants. The viscosity of the light duty liquid composition desirably will be at least 100 centipoises (cps) at room temperature, but may be up to 1,000 centipoises as measured with a Brookfield Viscometer using a number 21 spindle rotating at 20 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of some compositions is substantially neutral to skin, e.g., 4.5 to 8 and preferably 5.0 to 7.0. Other compositions may be acidic with pH=3–4.5 The pH of the composition can be adjusted by the addition of $Na_2O$ (caustic soda) to the composition.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

The following formulas were prepared at room temperature by simple liquid mixing procedures as previously described

| | A | B | C |
|---|---|---|---|
| Water | Balance | Balance | Balance |
| CAP betaine | .500 | 0.00 | 0.00 |
| Magnesium LAS | 12.915 | 9.00 | |
| NaLAS | 12.915 | 3.00 | 0.00 |
| NH4 AEOS 1.3 EO | 12.670 | 11.5 | |
| APG | 0.00 | 10.0 | |
| Lauryl myristyl amidopropyl amineoxide | 0.00 | 5,34 | |
| LMMEA/SXS | 0.00 | | |
| Citric acid, anhydrous | 1.000 | 0.00 | 0.00 |
| Natural Extract Blend | 0.100 | 0.1 | 0.1 |
| PEG-300 | 4.000 | 0.00 | 0.00 |
| HEDTA | 0.083 | 0.00 | |
| DTPA | 0.00 | 0.125 | |
| Sodium bisulfite | 0.00 | 0.075 | 0.00 |
| Preservative | 0.00 | 0.07 | 0.07 |
| Perfume/UV absorber | 0.465 | 0.45 | |

-continued

| | A | B | C |
|---|---|---|---|
| Color solution | 0.14 | 0.18 | |
| pH | 3.5 | 6.75 | 5.5 |

1. The Nautral Extract Blend contains fresh lime juice, mandarin fruit juice, honeydew fruit juice, and peach juice.

EXAMPLE 2

The following formulas were prepared at room temperature by simple liquid mixing procedures as previously described

| | A | B |
|---|---|---|
| Water | Balance | Balance |
| CAP betaine | .500 | 0.00 |
| MgLAS | 12.915 | 9.00 |
| NaLAS | 12.915 | 3.00 |
| NH4 AEOS 1.3 EO | 12.670 | 11.5 |
| APG | 0.00 | 10.0 |
| Lauryl myristyl amidopropyl amineoxide | 0.00 | 5,34 |
| LMMEA/SXS | 0.00 | |
| Citric acid, anhydrous | 1.000 | 0.00 |
| Natural Extract Blend | 0.100 | 0.1 |
| PEG-300 | 4.000 | 0.00 |
| HEDTA | 0.083 | 0.00 |
| DTPA | 0.00 | 0.125 |
| Sodium bisulfite | 0.00 | 0.075 |
| Preservative | 0.00 | 0.07 |
| Perfume/UV absorber | 0.465 | 0.45 |
| Color solution | 0.14 | 0.18 |
| Performance: | | |
| Shine-Black tiles (same day) | 124.6%** | 107.2% |
| Shine-Black tiles (next day) | 89.8% | 82.8% |
| Shine-Boroglass tiles | 91.9% | 88.4% |

1. The Natural Extract Blend contains fresh lime juice, mandarin fruit juice, honeydew fruit juice, and peach juice. Extrapone fruit bundle (ENTw/03)
The % refers to (cleaned-soiled)/(unsoiled-soiled)

Gloss Measurements Methodology

High gloss characteristics was observed visually while performing routine lab testing on our new low pH acid formulations. However, to exploit these shine attributes we needed a better way to quantify this improvement. After repeated testing on various surfaces (clear glass drinking jars, borosilicate glass plating, and black ceramic tiles) we found that the black tiles were best for gathering and for reproducible data.

Black tiles were prepared by first using a caustic alcoholic etching solution then cleaned and rinsed thoroughly for an unadulterated surface. Five gloss measurements (gu=gloss units) were taken equi-distance vertically down the 4"×4" black tile and then four measurements taken equi-distance horizontally across for a total of nine measurements. Measurements were taken before and after soiling and after the final washing/rinsing phase. Soiling was performed by placing the black tiles in a dishwashing machine run at full cycle using 150 ppm hard water, a 40 gm milk & margarine soil load was added, and no dishwashing detergent used. This yields a uniform dried soil onto the black tiles.

The tiles were then washed in a basin with a sponge for 30 seconds at 1 15 deg. tap water using a 10% LDL solution. Tiles were then rinsed for 30 seconds and dried vertically and placed in a constant temperature/humidity chamber. Final gloss measurements were taken when tiles have equalibrated at the specified temperature and humidity. The instrument used for gloss measurements was the handheld Micro TRI Gloss meter at a 20 Degree angle made by BYK-Gardner Inc.

What is claimed is:

1. A light duty liquid dishwashing composition comprising approximately by weight:

(a) 1% to 60% of at least one anionic surfactant;

(b) 0.01% to 2.0% of a mixture of natural extracts in an aqueous solution comprising by weight: 10% to 15% of lime juice; 0.1% to 1.0% of mandarin fruit juice; 0.1% to 1.0% of honeydew melon fruit juice; 0.1% to 1% of peach juice; 25% to 45% of propylene glycol; and the balance being water; and (c) the balance being water wherein the composition does not contain a polyoxyalkylene glycol fatty acid, a builder, a polymeric thickener, a clay, abrasive, silicas, triclosan, alkaline earth metal carbonates, alkyl glycine surfactants or cyclic imidinium surfactants.

2. A light duty liquid dishwashing composition according to claim 1 further including 0.5% to 8% by weight of a solubilizing agent which is selected from the group consisting of ethanol, sodium chloride and a water soluble salts of $C_1$–$C_3$ substituted benzene sulfonate hydrotropes and mixtures thereof.

3. A light duty liquid dishwashing composition according to claim 1 further including at least one supplemental surfactant selected from the group consisting of ethoxylated nonionics, ethoxylated/propoxylated nonionics, amine oxides, zwitterionic surfactants, $C_{12-14}$ fatty acid alkanol amides, and alkyl polyglucosides and mixtures thereof.

4. A light duty liquid cleaning dishwashing composition according to claim 1 further including polyethylene glycol.

5. A light duty liquid dishwashing cleaning composition according to claim 1, further including 0.1% to 2.5% of a proton donating agent.

* * * * *